US009579908B2

(12) United States Patent
Akahori et al.

(10) Patent No.: US 9,579,908 B2
(45) Date of Patent: Feb. 28, 2017

(54) SHEET CONVEYING APPARATUS

(71) Applicant: CANON FINETECH INC., Saitama (JP)

(72) Inventors: Shizuka Akahori, Nagareyama (JP); Hirohisa Niida, Tokyo (JP)

(73) Assignee: Canon Finetech, Inc., Misato-shi (JP)

( * ) Notice: Subject to any disclaimer, the term of this patent is extended or adjusted under 35 U.S.C. 154(b) by 0 days.

(21) Appl. No.: 14/847,266

(22) Filed: Sep. 8, 2015

(65) Prior Publication Data

US 2016/0067985 A1 Mar. 10, 2016

(30) Foreign Application Priority Data

Sep. 10, 2014 (JP) ..... 2014-184337

(51) Int. Cl.
*B41J 11/00* (2006.01)
*B41J 13/00* (2006.01)

(52) U.S. Cl.
CPC ..... *B41J 11/007* (2013.01); *B41J 11/0085* (2013.01); *B41J 13/0018* (2013.01)

(58) Field of Classification Search
CPC ..... B41J 5/00
See application file for complete search history.

(56) References Cited

U.S. PATENT DOCUMENTS 4,207,579 A * 6/1980 Gamblin et al. ..... 347/104
5,040,000 A * 8/1991 Yokoi ..... B41J 2/16547 346/134
5,757,407 A * 5/1998 Rezanka ..... 347/102
6,846,061 B2 * 1/2005 Nakashima ..... B41J 2/16526 347/22
6,949,896 B2 * 9/2005 Andoh ..... G05B 19/416 318/135
7,021,756 B2 * 4/2006 Nakashima et al. ..... 347/104
7,334,862 B2 * 2/2008 Kachi ..... B41J 2/16585 347/22
7,552,679 B2 * 6/2009 Koike ..... 101/485
8,388,246 B2 * 3/2013 Spence ..... B41J 11/007 226/93
2002/0018097 A1 2/2002 Kitahara et al.
(Continued)

FOREIGN PATENT DOCUMENTS

JP 2005-096135 A 4/2005

*Primary Examiner* — Stephen Meier
*Assistant Examiner* — John P Zimmermann
(74) *Attorney, Agent, or Firm* — Fitzpatrick, Cella, Harlper & Scinto

(57) ABSTRACT

The sheet conveying apparatus includes a conveying belt including a placement area having a suction hole, and configured to convey a sheet with a vacuum force from the suction hole, a sheet supply unit capable of supplying a sheet to a supply position of the sheet with respect to the conveying belt; and a control unit configured to control the conveying belt so as to further move the conveying belt after the conveying belt conveys a last sheet to be conveyed. The control unit causes the conveying belt to wait after moving the placement area to a predetermined position in an area from a position in an upstream direction with respect to the moving direction of the conveying belt to the supply position in a conveying amount of the conveying belt corresponding to a time required for the sheet supply unit to convey a next first sheet to the supply position.

10 Claims, 12 Drawing Sheets

(56) References Cited

U.S. PATENT DOCUMENTS

| | | | | |
|---|---|---|---|---|
| 2006/0284953 | A1* | 12/2006 | Hatasa et al. | 347/105 |
| 2007/0126837 | A1* | 6/2007 | Takahashi et al. | 347/104 |
| 2013/0278664 | A1* | 10/2013 | Arakane et al. | 347/16 |
| 2015/0224767 | A1* | 8/2015 | Borrego Lebrato | B41J 2/2146 347/14 |

* cited by examiner

| FIG.5A | FIG.5B |
|---|---|

SHEET CONVEYING APPARATUS

BACKGROUND OF THE INVENTION

Field of the Invention

The present invention relates to a sheet conveying apparatus for conveying a sheet by a conveying belt having a suction hole while sucking the sheet.

Description of the Related Art

One example of a unit for conveying a sheet-type print medium, used in combination with an image printing apparatus, is a loop conveying belt that moves around while holding the print medium. With a conveying unit using the conveying belt, the print medium needs to be held without being displaced on the moving conveying belt. As the unit for holding the print medium on the conveying belt, a conveying unit using a suction system is known which adsorbs the print medium on the conveying belt by sucking air from a plurality of suction holes formed on the conveying belt. The suction system has advantages that the print medium can be held on the conveying belt and that small ink droplets (ink mist) not contributing to printing that are generated in the printing apparatus can be sucked and collected with air.

In general, in image printing apparatuses, small ink droplets are occasionally ejected together with main droplets when ink is ejected from ejection ports of a print head, and small ink droplets are occasionally generated by an impact or the like when ink droplets land on a print medium. These small ink droplets are sucked from the suction holes of the conveying belt as described above, but when the print medium comes near the suction holes, the ink droplets occasionally adhere to the print medium by going into an end portion or a back surface of the print medium, causing poor image quality. The adhesion of ink droplets causing such poor image quality is hereinafter referred to as an end portion stain or a back stain. In addition, an air flow toward suction holes occasionally causes displacement in the landing position of the main ink droplets ejected near the end portion of the print medium, which causes the image quality to fall out, leading to poor image quality.

On the other hand, US Patent Laid-Open No. 2002/0018097 discloses, as a technique of preventing the end portion stain, the back stain, and the landing displacement, an image printing apparatus in which a suction hole is formed only on two predetermined areas of a conveying belt and a print medium is fed to the conveying belt so as to cover one of the areas. According to the technique, there is no suction hole that is exposed to the outside near an end portion of the print medium, and therefore generation of an air flow causing the end portion stain, the back stain, and the landing displacement can be suppressed.

In US Patent Laid-Open No. 2002/0018097, however, the suction hole is provided only on the limited area on the conveying belt. Therefore, when a printing operation of a first sheet (first print) is started, the print medium and the suction hole may not be in an appropriate positional relation.

In this case, to match the position of the print medium with the position of the suction hole, it is required to have an operation of adjusting the positional relation between the area in which the suction hole is formed and the print medium by moving around the conveying belt before feeding the print medium to the conveying belt. This increases the time required before the first print.

SUMMARY OF THE INVENTION

A sheet conveying apparatus including: a conveying belt including a placement area having a suction hole, and configured to convey a sheet while being sucked by the suction hole; a sheet supply unit capable of supplying a sheet to a supply position of the sheet with respect to the conveying belt; and a control unit configured to control the conveying belt so as to further move the conveying belt after the conveying belt conveys a last sheet to be conveyed, and cause the conveying belt to wait after moving the placement area to a predetermined position in an area from a position in an upstream direction with respect to the moving direction of the conveying belt to the supply position in a conveying amount of the conveying belt corresponding to a time required for the sheet supply unit to convey a next first sheet to the supply position.

Further features of the present invention will become apparent from the following description of exemplary embodiments (with reference to the attached drawings).

DESCRIPTION OF THE EMBODIMENTS

Embodiments of a sheet conveying apparatus of the present invention will be described with reference to the attached drawings.

First Embodiment

Figure 1:
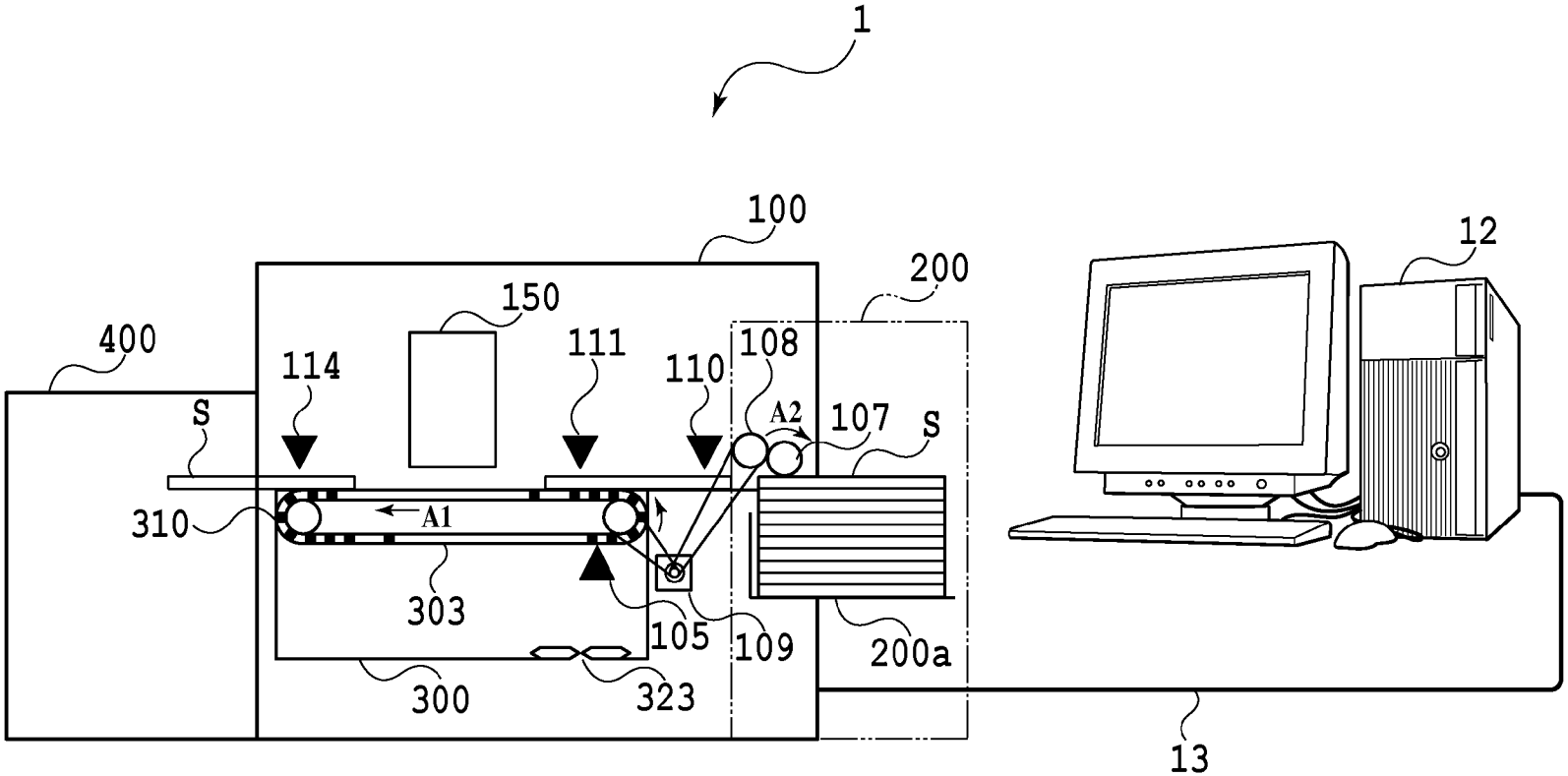
FIG. 1 is a side view schematically showing an image printing apparatus of an embodiment.

FIG. 1 is a view illustrating a printing system in which a major part of an image printing apparatus (hereinafter simply referred to as a printing apparatus) 1 using a sheet conveying apparatus of the present invention and a host computer (host device) 12 are connected. The printing apparatus 1 is connected to the host computer 12 as an information processing apparatus by a printer cable 13. The host computer 12 outputs print data, information relating to a print medium, and the like to the printing apparatus 1 as a control command via the printer cable 13.

The printing apparatus 1 of the present embodiment is provided with a print head 22 (see FIG. 2) for ejecting ink onto a print medium (cut sheet) S to print an image and a recovery unit for maintaining a printing performance of the print head 22. The print head 22 and the recovery unit are designed in modules and configured as a printing unit 150. The recovery unit has a configuration in which a cap covering ejection ports of the print head 22 as described above, a pump for generating a negative pressure in a space formed by the cap and an ejection port surface of the print head to perform a suction recovery operation, a pump motor for driving the pump, and the like are incorporated.

The printing apparatus 1 has an operation panel 103 and a feeding unit 200 for feeding a print medium one by one from a feeding tray 200*a*. The printing apparatus 1 has a conveying unit 300 for conveying a print medium S and a stacker unit (discharging unit) 400 for piling up the discharged print medium S. Although not shown, the printing apparatus 1 also has an ink supply unit for supplying ink to the print head 22, a maintenance tank unit for storing waste ink produced in cleaning of the print head, and the like.

The feeding unit 200 is provided with a feeding roller 107 and a feeding clutch 108. The conveying unit 300 is provided with a conveying belt 303 partly having suction holes 310, a conveying motor 109, and a suction fan 323. In the present embodiment, the feeding roller 107 is rotated and the conveying belt 303 is moved around by using the single conveying motor 109 which is a common driving source. The driving force of the conveying motor 109 is directly transmitted to the conveying belt, but is transmitted to the feeding roller 107 via the clutch. Therefore, when the conveying motor 109 is driven, the conveying belt 303 always moves around in a direction A1, whereas the feeding roller 107 rotates in a direction A2 only when the clutch 108 is connected. Further, when the clutch 108 is disconnected, the driving force of the conveying motor 109 is not transmitted to the feeding roller 107, and the feeding roller 107 does not rotate.

Rotating the feeding roller 107 in the direction A2 allows the print sheet S on top of the feeding tray 200*a* to be picked up and fed to the conveying belt 303. Further, the print medium fed to the conveying belt 303 is sucked and held on the upper surface of the conveying belt 303 by a suction operation of the suction holes 310 (described later) formed on the conveying belt 303, and is moved in the arrow direction A1 with the conveying belt 303. It should be noted that the suction force in the suction holes 310 is produced by the rotation of the suction fan 323.

Figure 2:
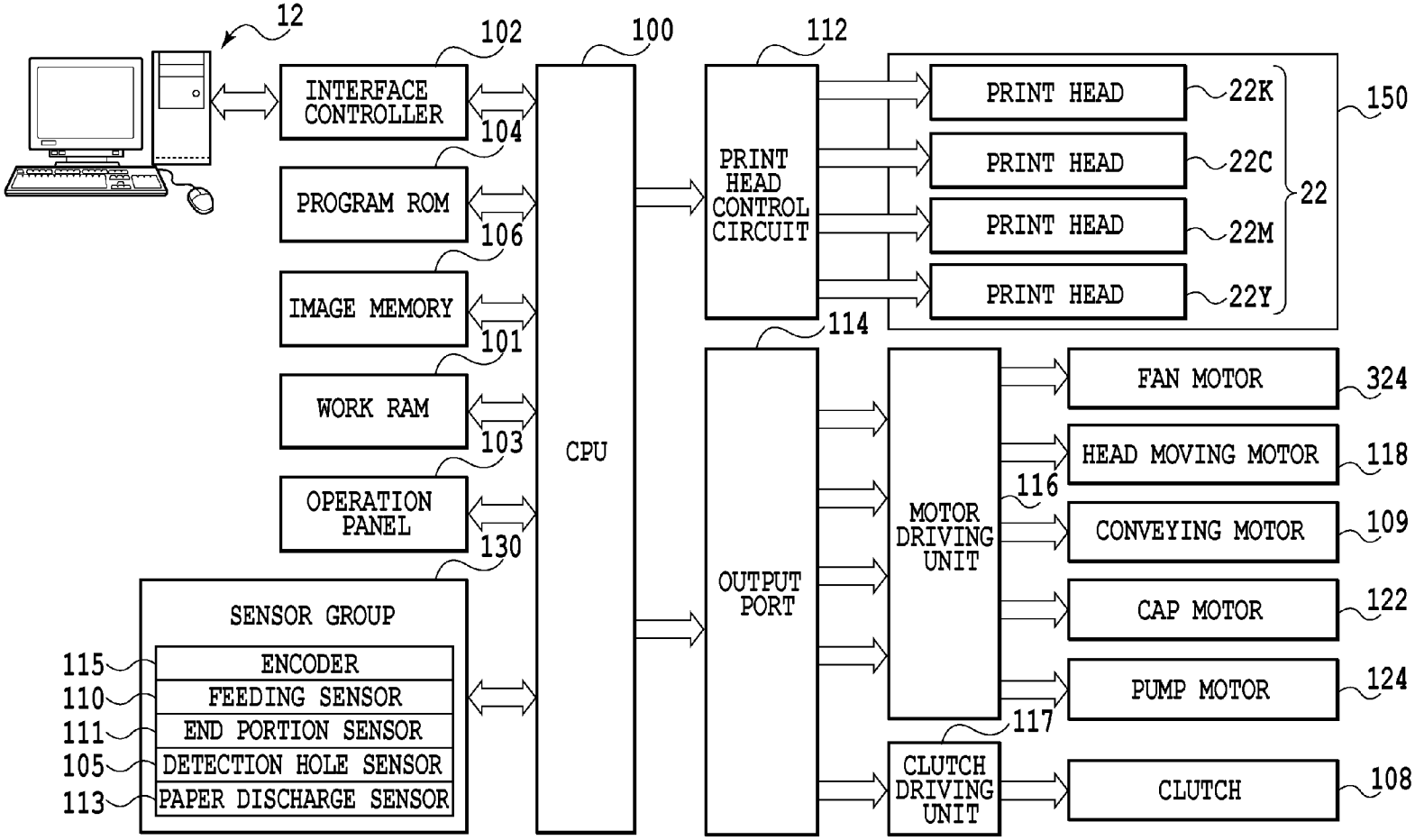
FIG. 2 is a block diagram showing a control system of the embodiment.

The printing apparatus 1 in the present embodiment is provided with a printing unit 150 for performing printing on the print medium S that has been conveyed by the conveying belt 303. On the printing unit 150, a print head of an ink jet type is mounted as a printing unit. In the present embodiment, the print head includes four print heads 22K, 22C, 22M, and 22Y as shown in FIG. 2 arranged along a conveyance direction in which the print medium S is conveyed (the arrow direction A1). The four print heads 22K, 22C, 22M, and 22Y eject black, cyan, magenta, and yellow inks, respectively. The print heads 22K, 22C, 22M, and 22Y are so-called line heads and extend in a direction perpendicular to a sheet surface shown in FIG. 1 (a direction perpendicular to the arrow direction A1). Further, each of the print heads 22K, 22C, 22M, and 22Y is provided with a plurality of ejection ports that can eject ink. The length of an ejection port array consisting of the plurality of ejection ports is set a little longer than the maximum width of the print medium to be used. It should be noted that in the following description, the print head is denoted by the reference numeral 22 unless distinction among the print heads is needed.

The print head 22 is movable between a cap position and a printable position by a head moving motor 118 shown in FIG. 2. While printing is not performed, the print head 22 is held in the cap position at which the cap may cover the ejection ports, whereas during printing, the print head 22 moves to the printable position in which the print head is located away from a cap member to allow printing on the print medium. It should be noted that, by a cap motor 122 (see FIG. 2), the cap is also movable between the printable position located away from the print head and the cap position at which the cap covers the ejection ports of the print head.

FIG. 2 is a block diagram showing the configuration of a control system of the printing apparatus in the present embodiment. Print data and commands transmitted from the host device 12 are received by a CPU 100 via an interface controller 102. The CPU 100 is an arithmetic processing unit serving as a control unit having control over the printing apparatus 1, such as reception of print data in the printing apparatus 1, a printing operation, and feeding and conveyance of the print medium S. The operations of the CPU 100 are executed based on processing programs, tables, and the like stored in a program ROM 104. Further, a work RAM 101 is used as a working memory.

After analyzing the command transmitted from the host device 12, the CPU 100 performs a processing operation in response to the command. For example, in a case where a printing instruction and print data are transmitted from the host device 12, image data on each color component of the print data is expanded into a bitmap in an image memory 106. Further, as a preparation operation before printing, the CPU 100 drives the cap motor 122 and the head moving motor 118 via an output port 114 and a motor driving unit 116 to move the print head 22 and the cap member.

The CPU 100 controls driving of the conveying motor 109 serving as a common driving source for moving the conveying belt 303 and rotating the feeding roller 107, which will be described later, via the output port 114 and the motor driving unit 116. The CPU 100 further controls the operation of the clutch (switching unit) 108 for switching between transmission and disconnection of the driving force from the conveying motor 109 to the feeding roller 201 via a clutch driving unit 117. Further, the CPU 100 also drives a fan motor 324 for rotating the suction fan 323 via the motor driving unit 116.

The CPU 100 is connected to a sensor group 130 including various sensors for detecting a conveying position and a conveying status of the print medium in the printing apparatus 1. The sensor group 130 includes a sensor for detecting in which part of a path (described later) of the print medium, from the feeding unit 200 to the discharging unit 400, the print medium exists. Examples of the sensor include a feeding sensor (second detection unit) 110 for detecting a leading end of the fed print medium S and feeding the print medium S to a predetermined position on the conveying belt 303, as shown in FIGS. 6A to 6D. Further, an end portion sensor 111 is provided between a print start position P4 at which printing is started by the print head 22 and a meeting position P3, and a leading end of the print medium S is detected before printing is performed by the print head 22. Further, examples of the sensors include a detection hole sensor 105 for detecting the position of a detection hole 321 (see FIGS. 4A and 4B) (described later) formed on the conveying belt 303, a paper discharge sensor 113 for detecting that the print medium is discharged, and an encoder 115 (see FIG. 2) for detecting a moving amount of the conveying belt. It should be noted that the encoder 115 is configured by a light projector/receiver and a code wheel fixed to a rotating shaft that rotates integrally with a pair of pulleys over which the conveying belt 303 runs, and the like.

Detection signals outputted from these sensors are inputted to the CPU 100, and in response to the detection signals, the CPU 100 performs operation control of the units, data processing, and the like. For example, once a leading end detection signal of the print medium is inputted to the CPU 100, print data on each color is sequentially read from the image memory 106 in synchronism with the conveying operation of the print medium S and the read data is transferred to each print head 22 via a print head control circuit 112. Further, to recover an ejection performance of the print head 22, the CPU 100 drives a pump motor 124 that is in communication with the cap member via the motor driving unit 116 and performs a suction recovery operation for sucking ink from the ejection ports of the print head 22 via the cap member.

Figure 3:
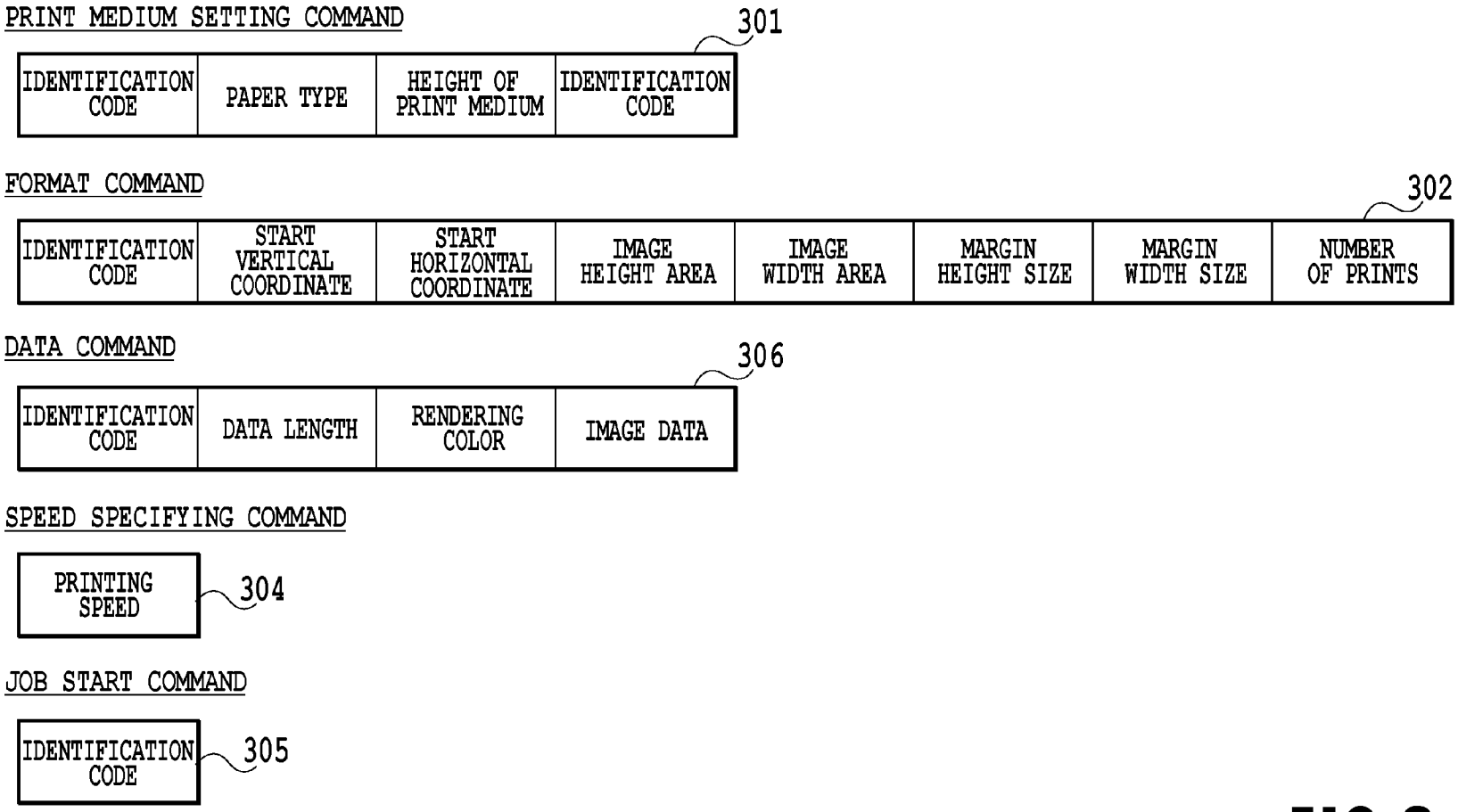
FIG. 3 illustrates printing commands used in the embodiment.

FIG. 3 illustrates printing commands transmitted from the host device 12 to the printing apparatus 1. Examples of the printing commands include a print medium setting command 301 for notifying the type, size, and the like of print medium and a format command 302 for specifying a print area and the like. Further, examples of the printing commands also include a data command 306 for notifying print data on a print image, a speed specifying command 304, and a job start command 305, and the printing is performed based on these printing commands.

Figure 4A:
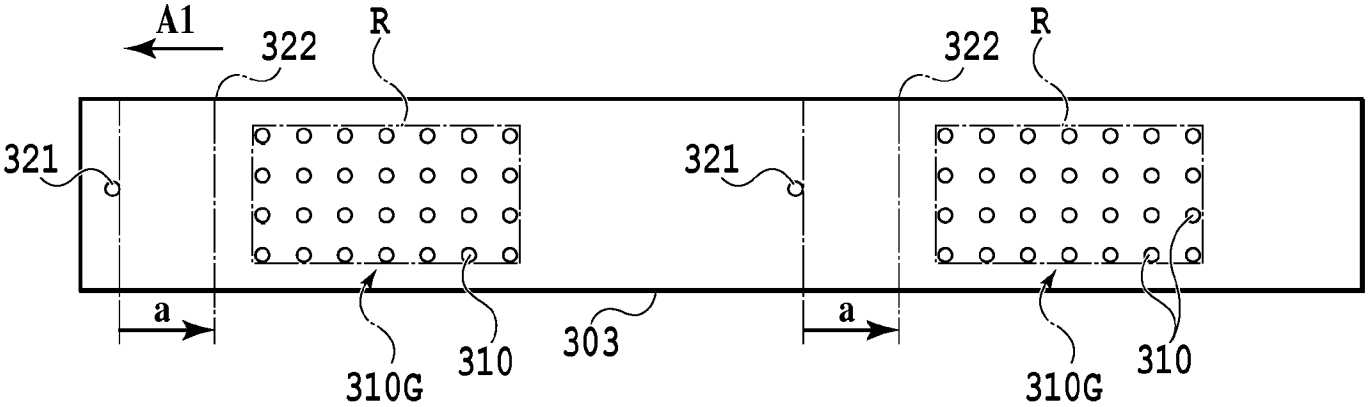
FIGS. 4A and 4B show arrangement of suction holes on the conveying belt in the embodiment.
Figure 4B:
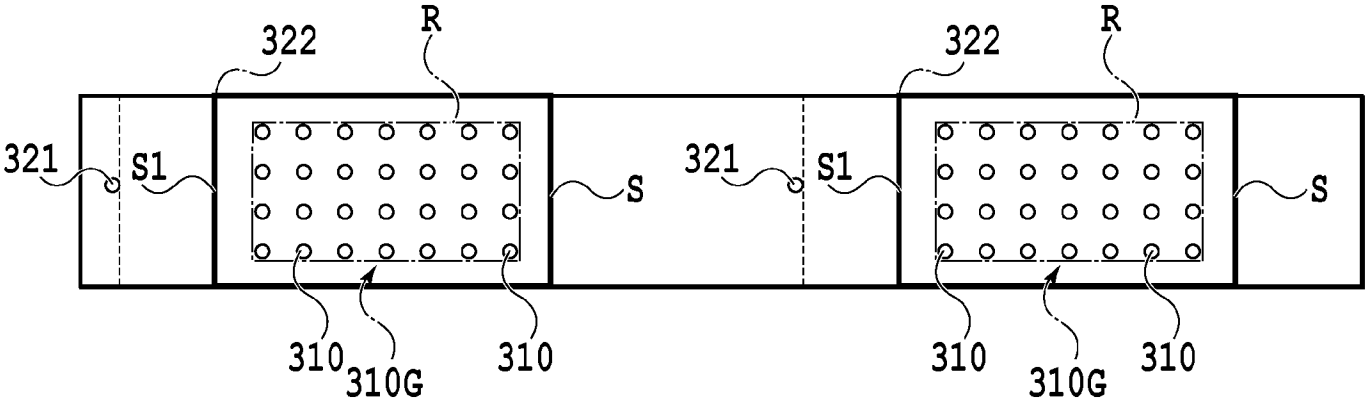

FIGS. 4A and 4B show arrangement of suction holes 310 formed on the conveying belt used in the present embodiment. In a predetermined area R of the conveying belt 303, a plurality of suction holes 310 are formed in a group. A group of suction holes 310 formed in the area R is hereinafter referred to as a suction hole group 310G. The area R is provided within an area in which the print medium S is placed, and has a size and shape that can be completely covered by the smallest print medium to be used. In the present embodiment, the two areas R forming the suction hole group 310G are spaced apart from each other by a predetermined distance on an endless belt which is looped around. Further, a position 322 upstream of and apart from the detection hole 321 by a distance a is predetermined on the conveying belt for positioning a leading end S1 of the print medium S, and this position is hereinafter referred to as an on-belt medium leading end position. In the present embodiment, by locating the leading end S1 of the print medium S on the on-belt medium leading end position 322, the print medium S can completely cover the suction hole group 310G.

As described above, the conveying belt 303 is configured such that air suction is not performed for portions other than the suction hole group 310G. More specifically, the conveying belt 303 is divided into an area in which the print medium S is placed and an area in which the print medium S is not placed, and the suction hole group 310G is formed only in the area R in the area in which the print medium is placed. In a case where the suction hole group 310G fed to the conveying belt 303 is completely covered by the fed print medium, air is not sucked from the outside of the print medium. Accordingly, it is possible to prevent small ink droplets from going into the back of the print medium S, and degradation of the image quality caused by landing displacement of main ink droplets or the like can be reduced. It should be noted that the conveying belt 303 is provided with the detection hole 321 to monitor a moving position of the belt, but this does not affect an image formed on the print medium as an air flow generated in the detection hole 321 is little.

Figures 5, 5A:
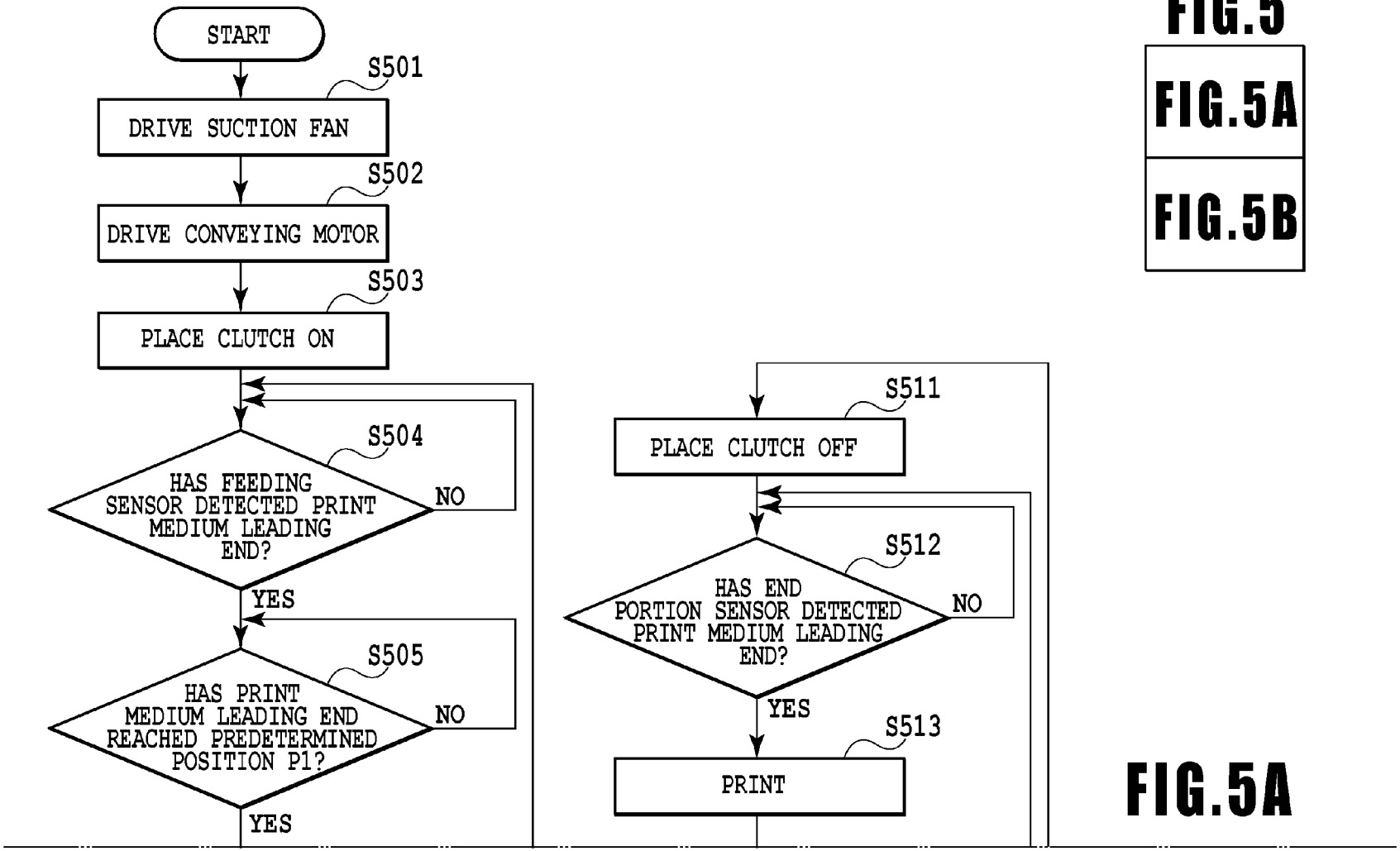
FIG. 5 is a diagram showing the relationship of FIGS. 5A and 5B.
FIG. 5A is a flow chart showing a control operation in a first embodiment.
Figure 5B:
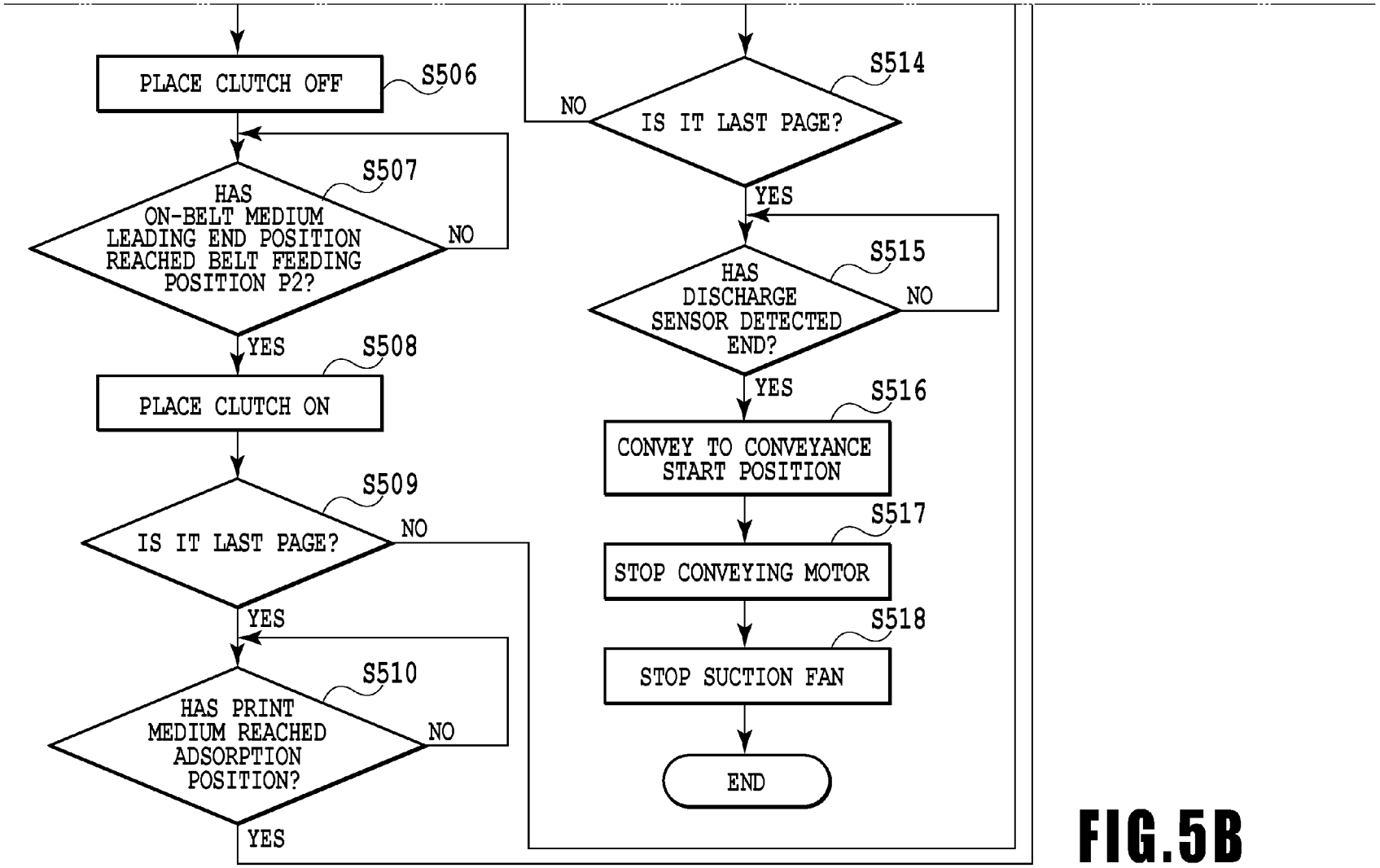
FIG. 5B is a flow chart showing a control operation in a first embodiment.

Accordingly, in the present embodiment, the following control is performed so that feeding is properly and efficiently performed by the feeding roller 107 in a manner that the print medium S may completely cover the suction hole group 310G. FIG. 5 is a flow chart showing a control operation in the present embodiment. A series of printing operations in the present embodiment will be described with reference to this flow chart and the diagrams illustrating the operations shown in FIGS. 6A to 6D and FIGS. 7A to 7C.

Figure 6A:
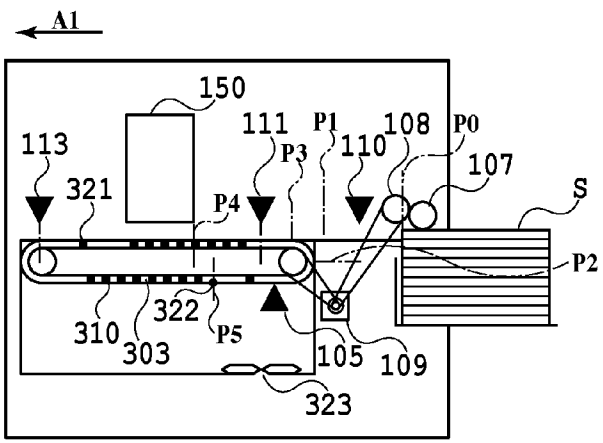
FIGS. 6A to 6D are diagrams schematically showing the operations of the apparatus shown in FIG. 1.
Figure 6B:
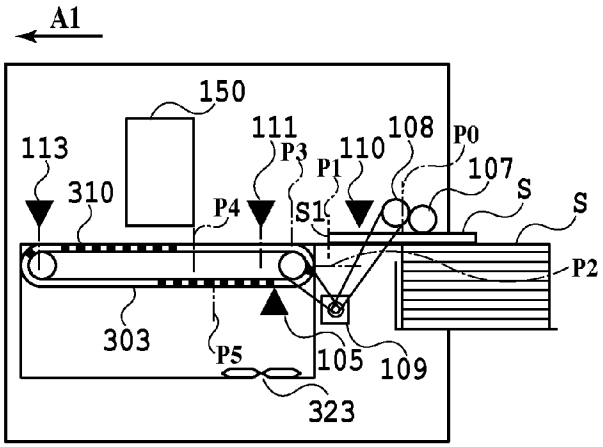

In the initial state shown in FIG. 6A, once a print start instruction is inputted from the host device 12 to the printing apparatus 1, the CPU 100 drives the fan motor 324 to rotate the suction fan 323 (S501). Accordingly, air suction is started from the suction hole group 310G of the conveying belt 303. Here, in FIG. 6A, the on-belt medium leading end position 322 predetermined on the conveying belt 303 is located on a moving start position P5, which will be described later.

Positions shown in P0 to P5 in FIGS. 6A to 6D are predetermined in the printing apparatus 1. The position P1 is predetermined in a feeding path for the print medium, and the positions P2 to P5 are predetermined on a loop belt moving path on which the conveying belt 303 moves.

After the driving of the suction fan 323 is started, the CPU 100 drives the conveying motor 109 (S502). While the conveying motor 109 is driven, the detection hole sensor 105 detects a detection hole 321 on the conveying belt 303, and based on a detection timing of the detection hole 321, a moving position (the on-belt medium leading end position 322) of the conveying belt 303 is detected by the encoder 115. Detection of the moving position of the conveying belt 303 needs to be performed only once before the first printing is started. After that, detection may be performed every time before printing, but appropriate control may be performed without detection. More specifically, in a case where detection of the detection hole 321 is not performed before the printing operation is started, the moving position of the conveying belt 303 is stored in a ROM 202 or a RAM 203 at the time of the last stop of the conveying motor 109, and the printing operation may be performed based on the stored position of the belt.

Next, the CPU 100 places the clutch 108 into a connected state (ON) (S503), picks up the print medium S located at the initial position P0 by the feeding roller 107, and moves it to the conveying belt 303. Here, the CPU 100 determines whether the leading end S1 of the print medium S is detected by the feeding sensor 110 (S504). If the leading end S1 of the print medium S is detected, the CPU 100 determines whether the leading end S1 of the print medium S has reached the predetermined position P1 (S505). This determination is performed by determining whether the number of pulses outputted from the encoder 115 of FIG. 2 after the leading end S1 of the print medium S has reached the feeding sensor 110 has reached a predetermined number of pulses. If it is determined that the leading end S1 of the print medium S has reached the predetermined position P1, the CPU 100 places the clutch 108 into a disconnected state (OFF) (S506), and stops the rotation of the feeding roller 107 (see FIG. 6B). Here, a position on the conveying path at which the leading end S1 of the print medium S first reaches the on-belt medium leading end position 322 on the conveying belt 303 is referred to as the meeting position P3.

Then, the predetermined position P1 is set to any position upstream of the meeting position P3.

After that, the CPU 100 determines whether the on-belt medium leading end position 322 set on the conveying belt 303 has reached the belt feeding position P2 (S507). Here, the belt feeding position P2 is located in a direction opposite to the direction A1 from the meeting position P3 by a moving distance of the conveying belt 303 within a time required for the leading end S1 of the print medium S to move from the predetermined position P1 to the meeting position P3.

Figure 6C:
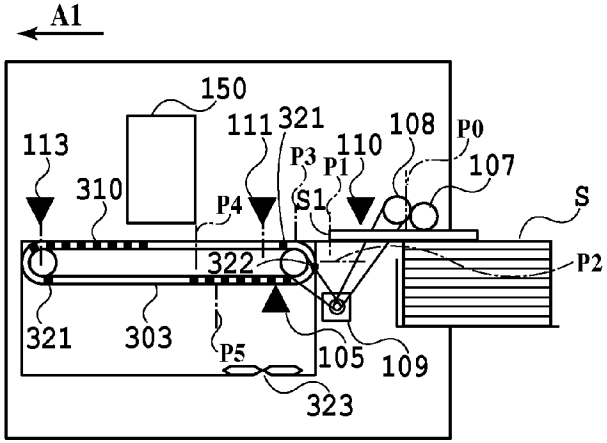

At the time when the on-belt medium leading end position 322 reaches the belt feeding position P2, the CPU 100 places the clutch 108 into the connected state (ON) (S508) and restarts the feeding of the print medium S (FIG. 6C). The CPU 100 also determines whether a page of the fed print medium S on which printing should be performed is the last page (S509). If it is determined that the page on which printing should be performed is the last page, it is determined whether the currently-fed print medium S has reached a position (suction position) at which the print medium S is sucked by the suction holes 310 of the conveying belt 303 (S510). If it is determined that the print medium has reached the suction position, the CPU 100 places the clutch 108 into the disconnected state (OFF) (S511), and the process proceeds to S512. When the clutch 108 is placed OFF in S511, the feeding roller 107 is kept in contact with the print medium S to print the last page, and is driven and rotates along the movement of the print medium until the print medium S conveyed by the conveying belt 303 goes out of the feeding roller 107. It should be noted that in S509, if it is determined that the page on which printing should be performed is not the last page, the process proceeds to S512.

Figure 6D:
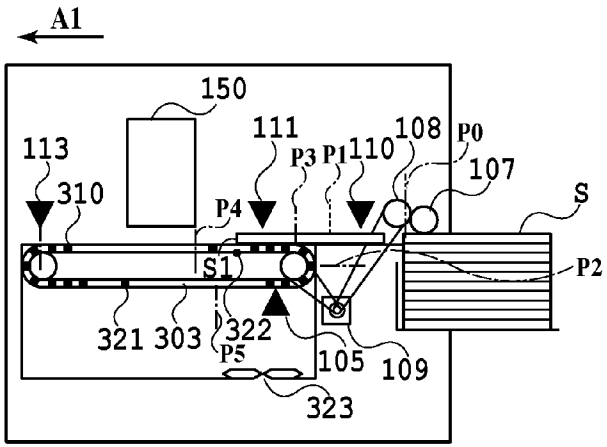

Next, the CPU 100 determines whether the end sensor 111 has detected the leading end S1 of the print medium S (S512). Here, as shown in FIG. 6D, if it is determined that the leading end S1 of the print medium S is detected by the end sensor 111, the CPU 100 determines that the leading end S1 of the print medium S has reached the print start position P4 at the time when the number of pulses from the encoder 115 has reached a predetermined number. Then, the CPU 100 starts a printing operation with respect to the print medium S that has reached the print start position P4 (S513 (FIG. 7A)) and determines whether the printed page is the last page (S514). If it is determined that the printed page is not the last page, the CPU 100 returns to the above-described S504 to perform the operation from S504 to S514.

Figure 7A:
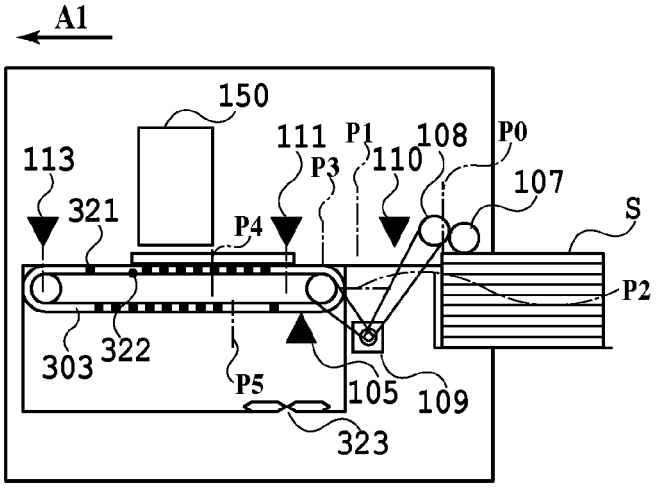
FIGS. 7A to 7C are diagrams schematically showing the operations of the apparatus shown in FIG. 1.
Figure 7B:
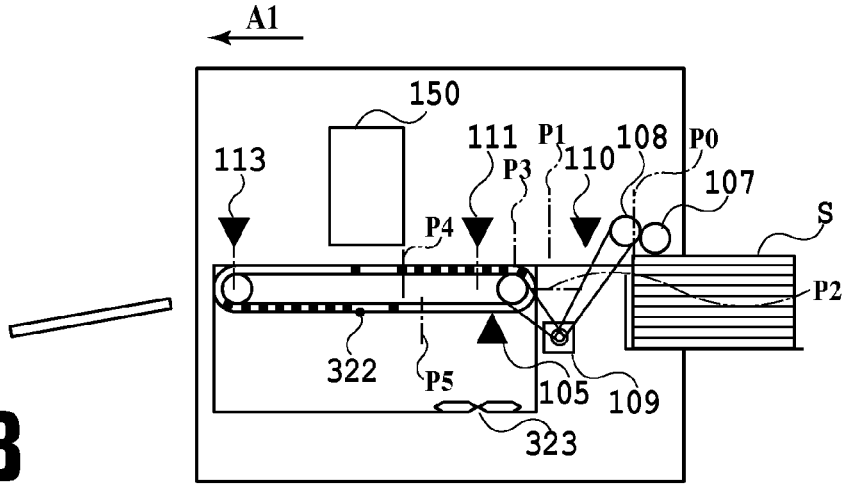
Figure 7C:
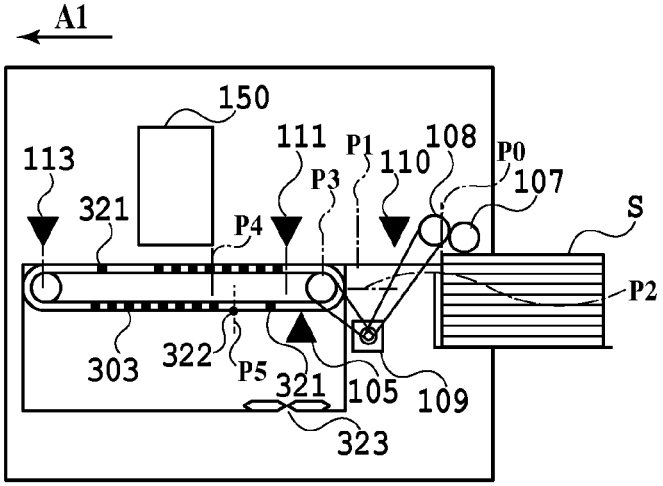

Meanwhile, if it is determined that the printed page is the last page in S514, the CPU 100 proceeds to S515, and determines whether the paper discharge sensor 113 has detected an end of the print medium S. If the end is detected, the print medium on which an image is printed is discharged to the discharging unit 400 (FIG. 7B). Further, the CPU 100 conveys the on-belt medium leading end position 322 on the conveying belt 303 to the moving start position P5 (S516 (FIG. 7C)). It should be noted that the moving start position P5 is located in a direction opposite to the direction A1 from the belt feeding position P2 by a conveying distance of the conveying belt 303 within a time required for the leading end S1 of the print medium S to move from the initial position P0 to the predetermined position P1. Further, a margin may be added to the moving start position P5 as set in the above manner in consideration of a slip or the like generated when the feeding roller 107 picks up and conveys the print medium S.

After moving the on-belt medium leading end position 322 to the moving start position P5 as described above, the CPU 100 stops the conveying motor 109 (S517) to stop the suction fan 323. (S518).

In the present embodiment as described above, the movement of the conveying belt 303 is not stopped immediately even after the printing operation, but the movement of the conveying belt 303 is stopped after moving the on-belt medium leading end position 322 on the conveying belt 303 to the moving start position P5. This allows prompt transition to the printing operation after a subsequent printing operation start instruction is received, without stopping the feeding operation and the movement of the conveying belt in the middle, whereby a time required for a first print may be greatly reduced. Further, since the print medium S can completely cover the suction hole group 310G of the conveying belt, it is possible to prevent small ink droplets from going into the back of the print medium and to reduce landing displacement of ink droplets, so that a good image quality may be obtained. It should be noted that in the present embodiment, the moving start position P5 is set based on the time required for the leading end S1 of the print medium S to move from the initial position P0 to the predetermined position P1, but the moving start position P5 may also be set based on a time required for the leading end S1 of the print medium S to move to the predetermined position P1 after a print start instruction is inputted.

Second Embodiment

Next, a description will be given of a second embodiment of the present invention with reference to FIG. 8 to FIG. 10C. It should be noted that also in the second embodiment, like the above-described first embodiment, the same configuration as the one shown in FIG. 1 to FIG. 4B is used, and in FIG. 8 to FIG. 10C, the parts corresponding to the parts shown in the first embodiment are indicated by the same reference numerals. A description thereof will be omitted.

A description will be given mainly of the differences between the second embodiment and the first embodiment. The above first embodiment shows the case where the moving start position P5 is set in consideration of only the feeding operation by the feeding roller 107. In the second embodiment, however, a print start position P5 is set in consideration of not only a time required for a feeding operation by a feeding roller 107 but also a time required for a preparation operation such as movement from a cap position to a printable position of each of a print head 22 and a cap member 24.

Figures 8, 8A, 8B:
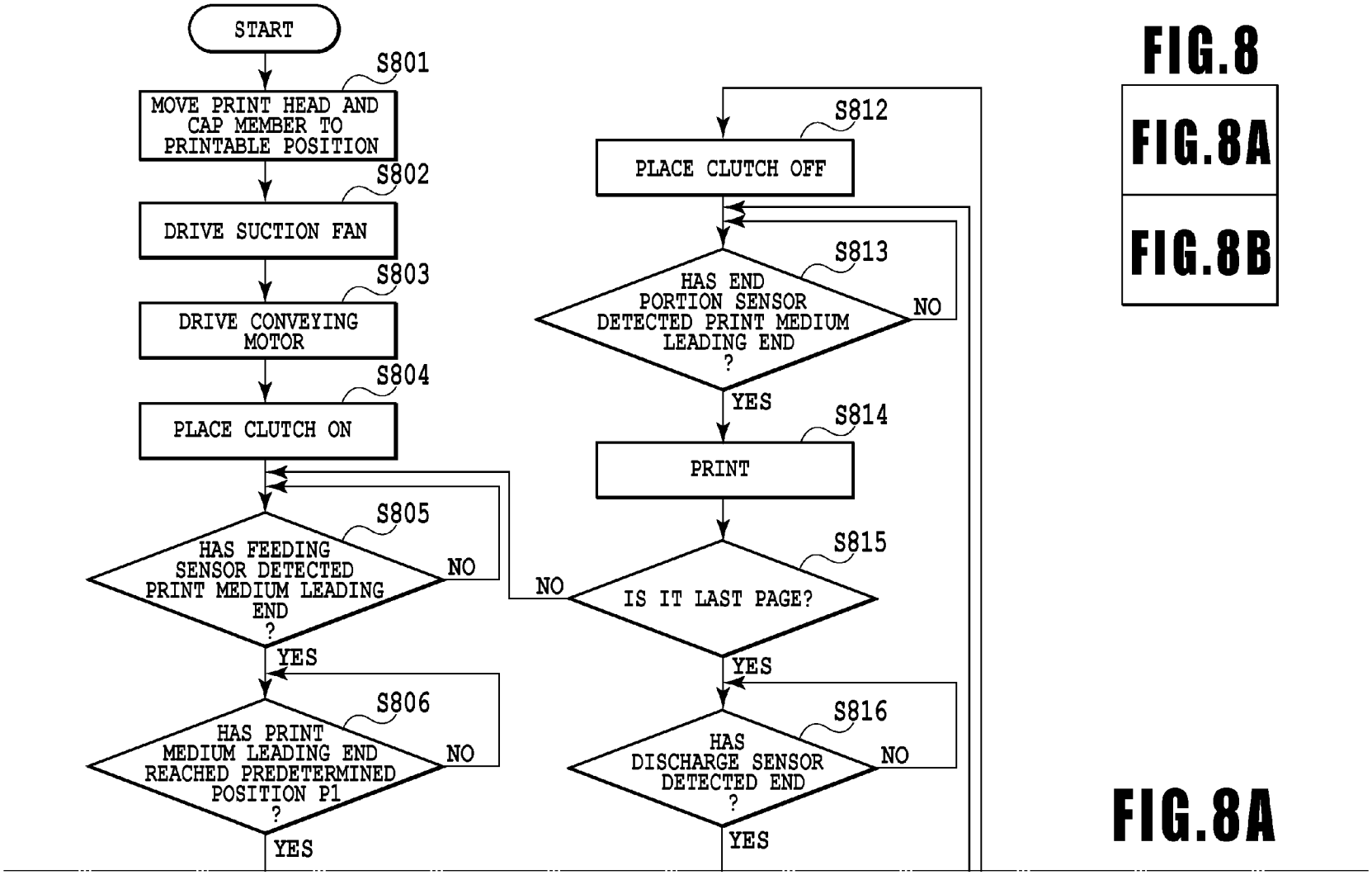
FIG. 8 is a diagram showing the relationship of FIGS. 8A and 8B.
FIG. 8A is a flow chart showing a control operation in a second embodiment.
FIG. 8B is a flow chart showing a control operation in a second embodiment.
Figure 8B:
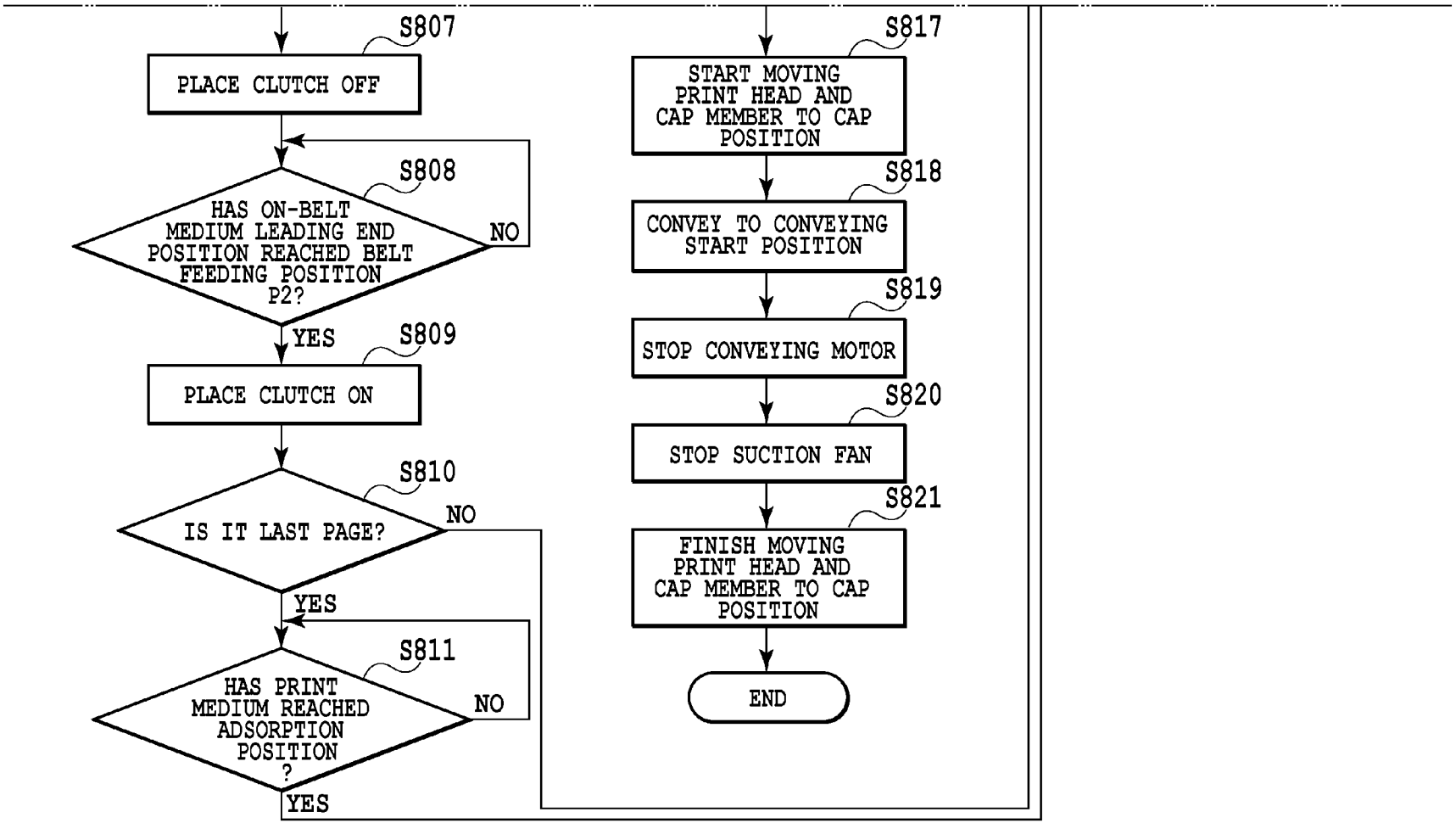

FIGS. 8A and 8B is a flow chart showing a control operation in the second embodiment. A series of printing operations in the present embodiment will be described with reference to this flow chart and the diagrams illustrating the operations shown in FIGS. 9A to 9D and FIGS. 10A to 10C.

Figure 9A:
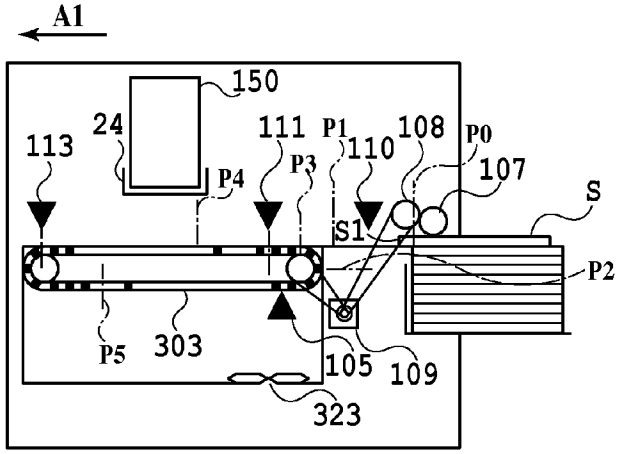
FIGS. 9A to 9D are side views schematically showing the operations of an image printing apparatus in the second embodiment.
Figure 9B:
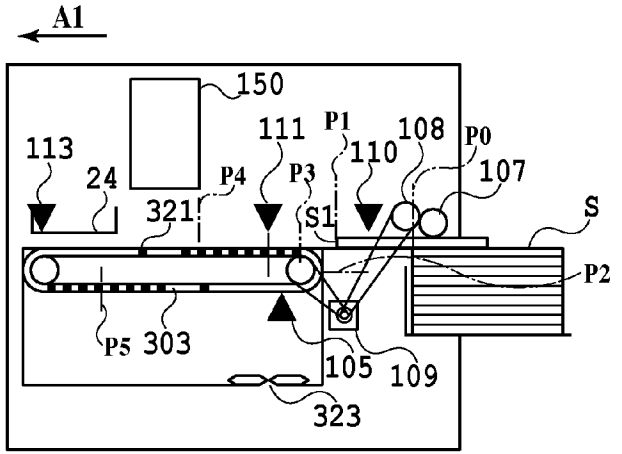

In the initial state shown in FIG. 9A, once a print start instruction is inputted from a host device 12 to a printing apparatus 1, as a preparation operation before a printing operation is started, a CPU 100 moves the print head 22 and the cap member 24 from a cap position to a printable position. In the movement to the printable position, first, the cap member 24 moves from the cap position (FIG. 9A) to the printing position (FIG. 9B), and then, the print head 22 moves from the cap position (FIG. 9A) to the printing position (FIG. 9D). Here, in FIG. 9A, an on-belt leading end position 403 on a conveying belt 303 is set in advance on a moving start position P5, which will be described later. Further, the moving start position P5 is calculated so that a leading end S1 of a print medium S reaches a print start position P4 by the time the movement to the printable position is completed. A calculation method will be described later.

Figure 10A:
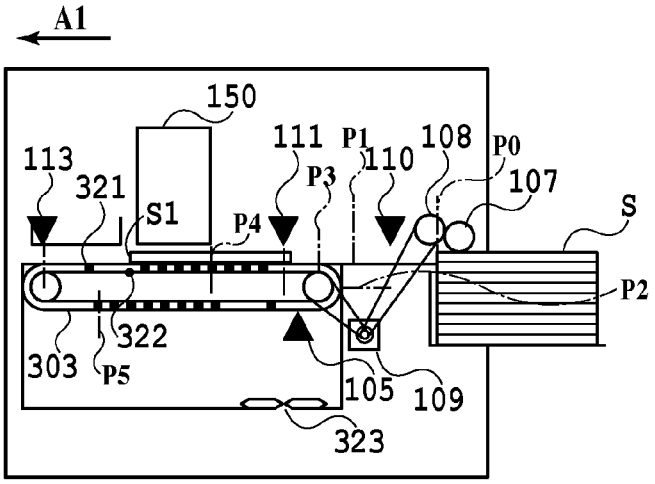
FIGS. 10A to 10C are side views schematically showing the operations of an image printing apparatus in the second embodiment.
Figure 10B:
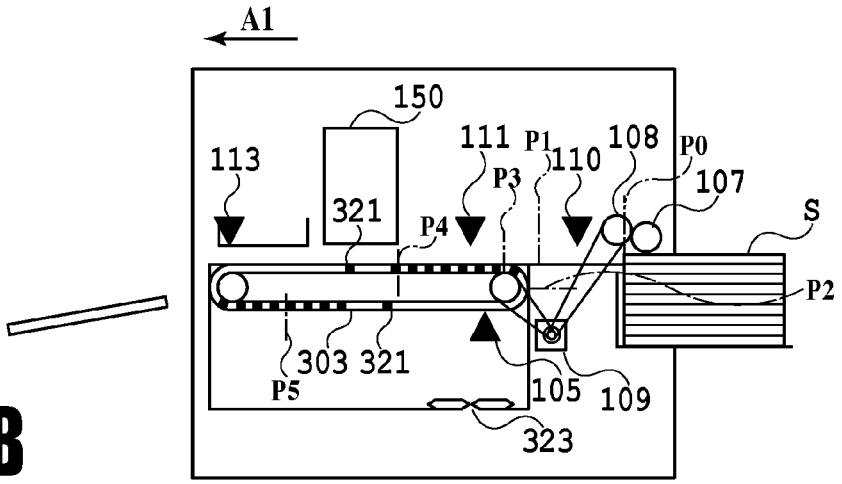
Figure 10C:
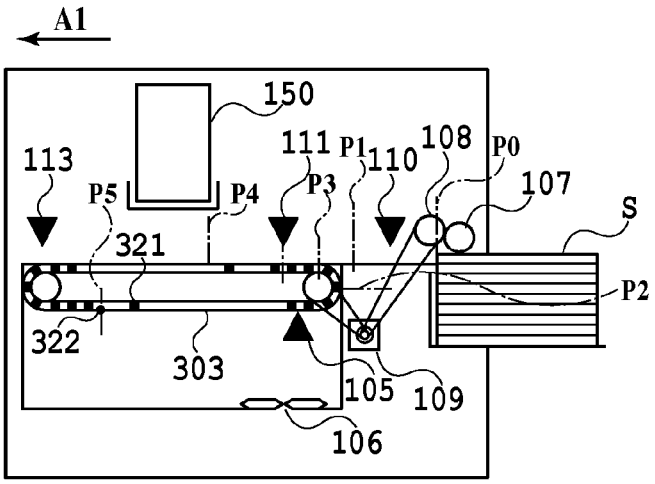

If the preparation operation is finished as described above, the CPU 100 drives a fan motor 324 to rotate a suction fan 323 (S802). Accordingly, air suction is started from a suction hole group 310G of the conveying belt 303. Here, in FIG. 9A, an on-belt medium leading end position 322 predetermined on the conveying belt 303 is located at the moving start position P5, which will be described later. Here, positions shown in P0 to P5 in FIGS. 10A to 10C are predetermined in the printing apparatus 1. The position P1 is predetermined in a feeding path for the print medium, and the positions P2 to P5 are predetermined in a loop belt moving path on which the conveying belt 303 moves.

After the driving of the suction fan 323 is started, the CPU 100 drives a conveying motor 109 (S803). While the conveying motor 109 is driven, a detection hole sensor 105 detects a detection hole 321 on the conveying belt 303, and based on a detection timing of the detection hole 321, a moving position (the on-belt medium leading end position 322) of the conveying belt 303 is detected by an encoder 115. Detection of the moving position of the conveying belt 303 needs to be performed only once before the first printing is started. After that, detection may be performed every time before printing, but appropriate control may be performed without detection. More specifically, in a case where detection of the detection hole 321 is not performed before the printing operation is started, the moving position of the conveying belt 303 is stored in a ROM 202 or a RAM 203 at the time of the last stop of the conveying motor 109, and the printing operation may be performed based on the stored position of the belt.

Next, the CPU 100 places a clutch 108 into a connected state (ON) (S804), picks up a print medium S located at the initial position P0 by a feeding roller 107, and moves it to the conveying belt 303. Here, the CPU 100 determines whether the leading end S1 of the print medium S is detected by a feeding sensor 110 (S805). If the leading end S1 of the print medium S is detected, the CPU 100 determines whether the leading end S1 of the print medium S has reached the predetermined position P1 (S806). This determination is performed by determining whether the number of pulses outputted from an encoder 115 after the leading end S1 of the print medium S has reached the feeding sensor 110 has reached a predetermined number of pulses. If it is determined that the leading end S1 of the print medium S has reached the predetermined position P1, the CPU 100 places the clutch 108 into a disconnected state (OFF) (S807), and stops the rotation of the feeding roller 107 (see FIG. 9B). Here, a position on the conveying path at which the leading end S1 of the print medium S first reaches the on-belt medium leading end position 322 on the conveying belt 303 is referred to as the meeting position P3. The predetermined position P1 is set to any position upstream of the meeting position P3.

After that, the CPU 100 determines whether the on-belt medium leading end position 322 set on the conveying belt 303 has reached the belt feeding position P2 (S808). Here, the belt feeding position P2 is located in a direction opposite to the direction A1 from the meeting position P3 by a moving distance of the conveying belt 303 within a time required for the leading end S1 of the print medium S to move from the predetermined position P1 to the meeting position P3.

Figure 9C:
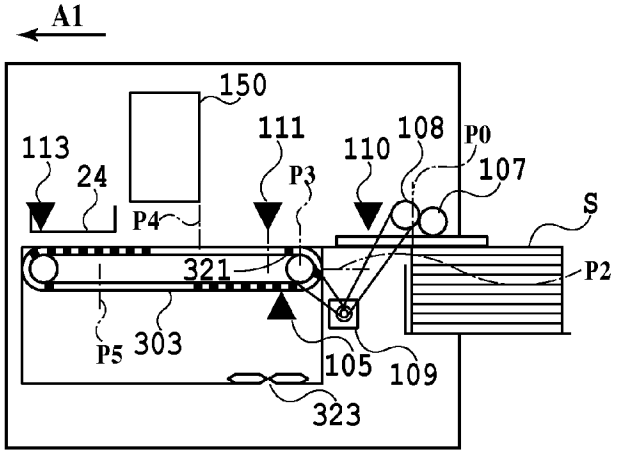
Figure 9D:
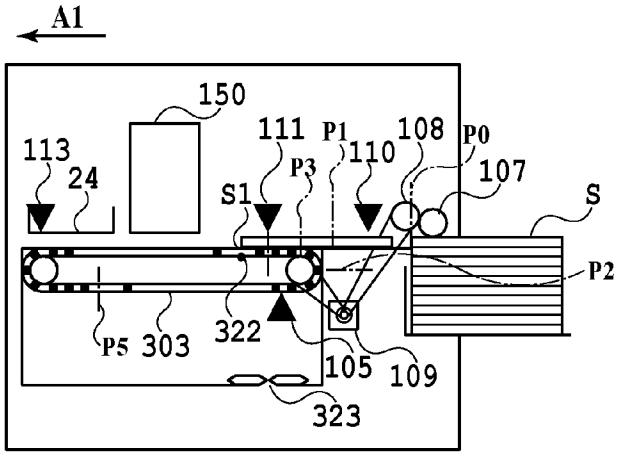

At the time when the on-belt medium leading end position 322 reaches the belt feeding position P2, the CPU 100 places the clutch 108 into the connected state (ON) (S809) and restarts the feeding of the print medium S (FIG. 9C). The CPU 100 also determines whether a page of the fed print medium S on which printing should be performed is the last page (S810). If it is determined that the page on which printing should be performed is the last page, it is determined whether the currently-fed print medium S has reached a position (suction position) at which the print medium S is sucked by suction holes 310 of the conveying belt 303 (S811). If it is determined that the print medium has reached the suction position, the CPU 100 places the clutch 108 into the disconnected state (OFF) (S812), and the process moves to S813. When the clutch 108 is placed OFF in S812, the feeding roller 107 is kept in contact with the print medium S to print the last page, and is driven and rotates along the movement of the print medium until the print medium S conveyed by the conveying belt 303 goes out of the feeding roller 107. It should be noted that in S810, if it is determined that the page on which printing should be performed is not the last page, the process proceeds to S813.

Next, the CPU 100 determines whether an end sensor 111 has detected the leading end S1 of the print medium S (S813). Here, as shown in FIG. 9D, if it is determined that the leading end S1 of the print medium S is detected by the end sensor 111, the CPU 100 determines that the leading end S1 of the print medium S has reached the print start position P4 at the time when the number of pulses from the encoder 115 has reached a predetermined number. Then, the CPU 100 starts a printing operation with respect to the print medium S in S811 (S814 (FIG. 10A)) and determines whether the printed page is the last page (S815). If it is determined that the printed page is not the last page, the CPU 100 returns to the above-described S805 to perform the operation from S805 to S815.

Meanwhile, if it is determined that the printed page is the last page in S815, the CPU 100 proceeds to S816, and determines whether a paper discharge sensor 113 has detected an end of the print medium S. If the end is detected, the print medium on which an image is printed is discharged to a discharging unit 400 (FIG. 10B) while the movement of the print head 22 and the cap member 24 to the cap position is started (S817). Further, the CPU 100 conveys the on-belt medium leading end position 322 on the conveying belt 303 to the moving start position P5 in S814 (FIG. 10C). It should be noted that the moving start position P5 is located in a direction opposite to the direction A1 from the belt feeding position P2 by a conveying distance of the conveying belt 303 within a time required for the leading end S1 of the print medium S to move from the initial position P0 to the predetermined position P1.

A calculation method of the moving start position P5 will be described. First, a time required for feeding the print medium S from the initial position P0 to the predetermined position P1 is indicated by T1 (feeding time T1), and a time required for moving the print medium S from the predetermined position P1 to the print start position P4 is indicated by T2 (time T2). Further, a time required for moving the print head 22 and the cap member 24 from the cap position to the printable position is indicated by T3 (preprinting operation time T3). Here, T3 and (T1+T2) are compared, and if T3 is less than (T1+T2), the printing preparation time is set to (T3−T2). If (T1+T2) is equal to or greater than T3, the printing preparation time is set to T1.

In the case of the present embodiment, the time T3 for moving the print head 22 and the cap member 24 from the cap position to the printing position is greater than a time (T1+T2) which is the sum of the time T1 for feeding the print medium S from the initial position P0 to the predetermined position P1 and the time T2 for moving the print medium from the predetermined position P1 to the print start time P4, so the printing preparation time is (T3−T2). In this case, the moving start position P5 is located in a direction opposite to the conveying direction A1 from a last position by a moving amount of the conveying belt 303 within a differential time between the time T3 and the time (T1+T2). It should be noted that the last position is located in a direction opposite to the conveying direction A1 from the belt feeding position P2 by a moving amount of the conveying belt 303 within the time (T1+T2).

After moving the on-belt medium leading end position 322 to the moving start position P5 as described above, the CPU 100 stops the conveying motor 109 (S819) to stop the suction fan 323 (S820). Further, after moving the print head 22 and the cap member 24 to the cap position at which ejection ports of the print head 22 are covered, the CPU 100 stops the movement of the print head 22 and the cap member 24 (S821).

In this manner, in the second embodiment, the time required for the movement of the print head 22 and the cap member 24 is set as the printing preparation time, and the moving start position P5 is set in consideration of the printing preparation time. This can efficiently set a position of the conveying belt by using the printing preparation time, and reliably achieve reduction of the time required for a first print. Further, since the print medium S can completely cover the suction hole group 310G of the conveying belt, it is possible to prevent small ink droplets from going into the back of the print medium and to reduce landing displacement of ink droplets, so that a good image quality may be obtained.

OTHER EMBODIMENTS

In the second embodiment as described above, the printing preparation time is calculated in consideration of the time for moving the print head 22 and the cap member 24 from the cap position to the printable position. However, irrespective of the movement from the cap position to the printing preparation position, the printing preparation time may be calculated based on the time required for other operation performed before printing such as recovery, preliminary ejection, and temperature adjustment. At this time, it is also possible to assume a plurality of types of printing preparation operations.

Furthermore, in the above-embodiments, when the printing operation is finished, the on-belt medium leading end position 322 on the conveying belt 303 is controlled to be located on the printing start position P5, but in initialization before printing is started, a set position of the on-belt medium leading end position on the conveying belt may be adjusted.

Further, the moving start position may be changed for each printing operation. For example, in a case where the printing preparation operation that is different from the last printing preparation operation is performed when a subsequent printing is started, a preprinting operation time when a subsequent printing is started may be calculated in advance. Then, when the last printing operation is finished or before a subsequent printing operation is started, the on-belt medium leading end position on the conveying belt may be located on the changed moving start position. This can set an appropriate moving start position depending on a status of the printing operation, and reduce a time for the first print with high precision.

Further, in the first and second embodiments, the examples have been shown in which the conveying belt 303 and the feeding roller 107 are driven by a common driving source (single conveying motor) 109, and the feeding roller 107 is provided with the clutch 108. However, separate driving sources may be used individually for the conveying belt 303 and the feeding roller 107 to independently control the driving sources. In this case, start timing of the conveying belt may be delayed by locating the on-belt medium leading end position 322 at a new moving start position in an area from p3 to p5.

Further, in a case where a printing preparation time T3 is equal to or less than (T1+T2), the conveying motor is driven after the print medium is moved to a predetermined position P1 by the feeding roller. At this time, if T3>0, the printing preparation operation is started after ((T1+T2)−T3) from the start of the driving of the feeding roller.

Further, if the printing preparation time T3 is greater than (T1+T2), after the elapse of (T3−(T1+T2)) after the printing preparation operation is started, the feeding by the feeding roller is started, and the conveying motor is driven after the print medium is conveyed to the predetermined position P1.

In a case where a printing speed that is different from the last printing speed is specified by a speed specifying command 304, the speed of the conveying motor 109 is changed before or during driving so as to avoid inconsistency between the feeding operation or the printing preparation operation of the print head and the timing of the conveying belt 303. For example, in a case where a printing speed lower than the last printing speed is specified, the conveying motor 109 may be driven at a speed greater than the last speed toward the belt feeding position 105, and then, the speed may be reduced before the belt feeding position and the conveying motor 109 may be driven at the specified speed from the belt feeding position 105.

In a case where a printing speed higher than the last printing speed is specified, the conveying motor is driven at a speed lower than the last speed toward the belt feeding position, and then, the speed is increased immediately before the belt feeding position and the conveying motor is driven at a specified speed from the belt feeding position. In this manner, inconsistency between the feeding operation of the print medium or the printing preparation operation of the print head and the timing of the conveying belt 303 is avoided, thereby preventing an increase in the time required for the first print.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-184337 filed Sep. 10, 2014, which is hereby incorporated by reference wherein in its entirety.

What is claimed is:

1. A sheet conveying apparatus comprising:

a conveying belt including a placement area having a suction hole, and configured to convey a sheet with a suction force from the suction hole;

a sheet supply unit capable of supplying a sheet to a supply position of the sheet with respect to the conveying belt; and a control unit configured to control the conveying belt so as to move the conveying belt after the conveying belt conveys a last sheet to be conveyed, cause the conveying belt to wait after moving the placement area to a predetermined position in an area from a position in an upstream direction with respect to a moving direction of the conveying belt to the supply position in a conveying amount of the conveying belt corresponding to a time required for the sheet supply unit to convey a next first sheet to the supply position, and cause the conveying belt to convey the next first sheet by moving the placement area from the predetermined position without stopping the placement area at the supply position.

2. The sheet conveying apparatus according to claim 1, wherein the control unit controls the conveying belt so as to cause the placement area to wait at the predetermined position.

3. The sheet conveying apparatus according to claim 1, further comprising a printing unit configured to perform printing on the sheet, wherein the control unit is configured to control the conveying belt such that, in a case where a time required for an operation of the printing unit performed prior to printing is greater than a time required for the sheet to be conveyed from the sheet supply unit to a print start position of the printing unit, the placement area is caused to wait at the position in the upstream direction of the conveying belt with respect to the supply position by the conveying amount of the conveying belt based on the time required for the sheet supply unit to convey the first sheet to the supply position and the time required for the operation of the printing unit performed prior to printing.

4. The sheet conveying apparatus according to claim 3, wherein the control unit is configured to control the conveying belt such that the placement area is caused to wait at the position in the upstream direction of the conveying belt with respect to the supply position in a manner corresponding to a differential time between the time required for the operation of the printing unit performed prior to printing and the time required for the sheet to be conveyed from the sheet supply unit to a print start position of the printing unit, in addition to the conveying amount of the conveying belt corresponding to the time required for the sheet supply unit to convey the first sheet to the supply position.

5. The sheet conveying apparatus according to claim 1, wherein the sheet supply unit supplies a sheet following the first sheet at a supply timing later than a supply timing of the first sheet.

6. The sheet conveying apparatus according to claim 4, wherein the sheet supply unit temporarily stops the conveyance of the sheet to delay the supply timing.

7. The sheet conveying apparatus according to claim 1, comprising:

a conveying belt driving source for driving the conveying belt;

a sheet supply unit driving source for driving the sheet supply unit; and a sheet position detection unit configured to detect a position of the sheet, wherein the control unit controls driving and stopping of the conveying belt driving source and the sheet supply unit driving source based on a detection result of the sheet position detection unit.

8. The sheet conveying apparatus according to claim 1, comprising:

a common driving source for driving the conveying belt and the sheet supply unit;

a switch unit configured to switch between transmission and disconnection of a driving force transmitted from the common driving source to the sheet supply unit; and a sheet position detection unit configured to detect a position of the sheet, wherein the control unit switches between transmission and disconnection of a power by the switch unit based on a detection result of the sheet position detection unit.

9. The sheet conveying apparatus according to claim 3, wherein the printing unit is an ink jet printing system for printing by ejecting a liquid to a sheet, and the operation of the printing unit performed prior to printing includes at least one of movement of the printing unit from an initial position to a printing position, recovery of the printing unit, preliminary ejection of the printing unit, and temperature adjustment of the printing unit.

10. The sheet conveying apparatus according to claim 1, wherein the control unit synchronizes a start of moving the conveying belt with a start of supplying the sheet by the supply unit.

* * * * *